US008602847B2

(12) United States Patent
Pei

(10) Patent No.: US 8,602,847 B2
(45) Date of Patent: Dec. 10, 2013

(54) CYLINDRICAL GRINDING AND POLISHING DEVICE

(75) Inventor: Shao-Kai Pei, Tu-Cheng (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 480 days.

(21) Appl. No.: 12/916,626

(22) Filed: Oct. 31, 2010

(65) Prior Publication Data

US 2012/0021678 A1 Jan. 26, 2012

(30) Foreign Application Priority Data

Jul. 23, 2010 (TW) ..... 99124444 A

(51) Int. Cl.
*B24B 7/06* (2006.01)

(52) U.S. Cl.
USPC ..... 451/66; 451/184

(58) Field of Classification Search
USPC ..... 451/65, 66, 184
See application file for complete search history.

(56) References Cited

U.S. PATENT DOCUMENTS 2,715,796 A * 8/1955 Beard et al. ..... 451/65
2,849,820 A * 9/1958 Reschke ..... 156/538
3,518,796 A * 7/1970 Gawronski ..... 451/184
4,733,500 A * 3/1988 David ..... 451/65
4,969,296 A * 11/1990 Seki et al. ..... 451/162
4,972,630 A * 11/1990 Seki et al. ..... 451/57
5,203,117 A * 4/1993 Jen ..... 451/296
5,873,773 A * 2/1999 Bando ..... 451/70
5,921,848 A * 7/1999 Zang et al. ..... 451/57
6,431,964 B1 * 8/2002 Ishikawa et al. ..... 451/65
6,602,118 B1 * 8/2003 Johnson ..... 451/65
2013/0012109 A1 * 1/2013 Pei ..... 451/67

FOREIGN PATENT DOCUMENTS

TW 426582 3/2001

* cited by examiner

*Primary Examiner* — Maurina Rachuba
(74) *Attorney, Agent, or Firm* — Altis Law Group, Inc.

(57) ABSTRACT

A cylindrical grinding and polishing device includes a main body defining a cavity, a polishing device, a cylindrical grinding device, a support device. The polishing device is received in the cavity, and includes a number of polishing wheels positioned along a first direction. The cylindrical grinding device is received in the cavity, and includes a grinding wheel positioned at an end of the cavity along a second direction substantially perpendicular to the first direction. The support device is received in the cavity, and includes a support plate for supporting a work-piece. The support device carries the work-piece to contact the polishing wheels or the grinding wheel.

10 Claims, 5 Drawing Sheets

CYLINDRICAL GRINDING AND POLISHING DEVICE

BACKGROUND

1. Technical Field

The present disclosure relates to a cylindrical grinding and polishing device.

2. Description of Related Art

A cylindrical grinding device, is used to round out workpieces. Before being processed by the cylindrical grinding device, the workpieces are usually processed by other devices. For example, for cylindrical grinding a round lens, first, a glass substrate is cut into many small rectangular pieces, and then the small rectangular piece is rolled to a round lens. However, after the cutting process, chips may stay on the surface of the work-piece and make the surface of the work-piece become uneven. If the work-piece with the chips is rolled, the work-piece will crack. As a result, the work-piece becomes unusable.

What is needed, therefore, is a cylindrical grinding and polishing device to overcome the above-described problem.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the embodiments.

DETAILED DESCRIPTION

Embodiments of the present disclosure will now be described in detail below, with reference to the accompanying drawings.

Figure 1:
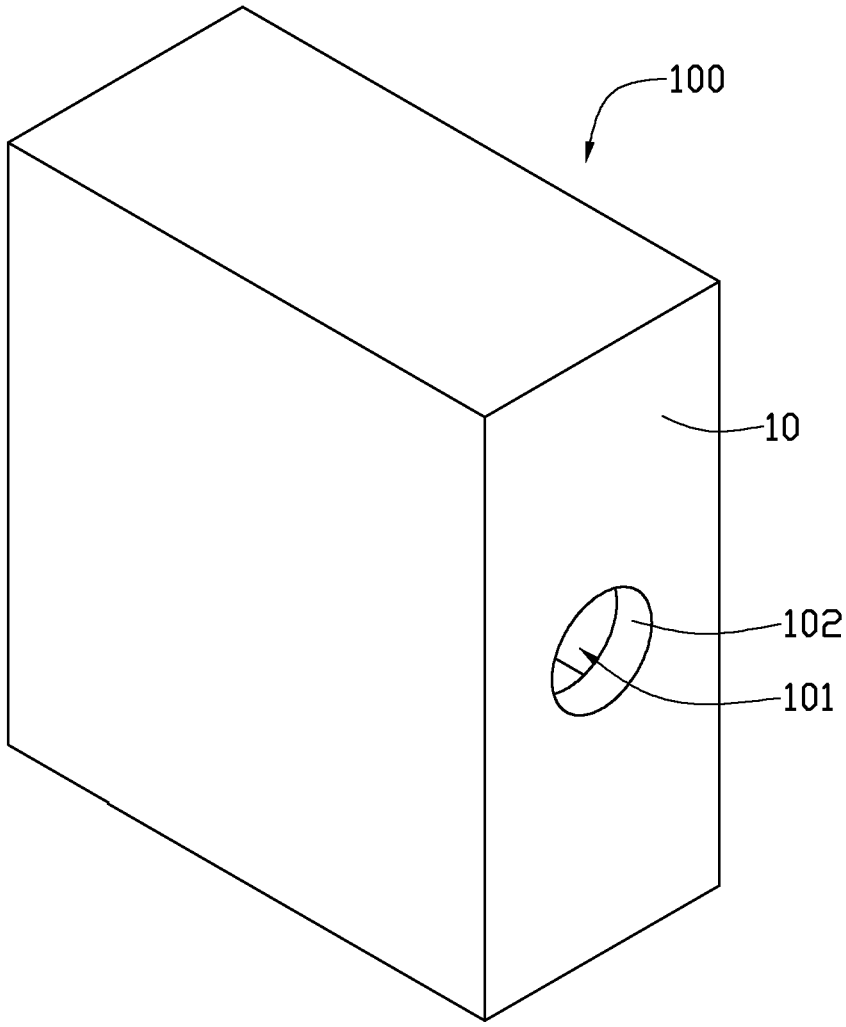
FIG. 1 is a schematic, isometric view of a cylindrical grinding and polishing device according to an exemplary embodiment.
Figure 2:
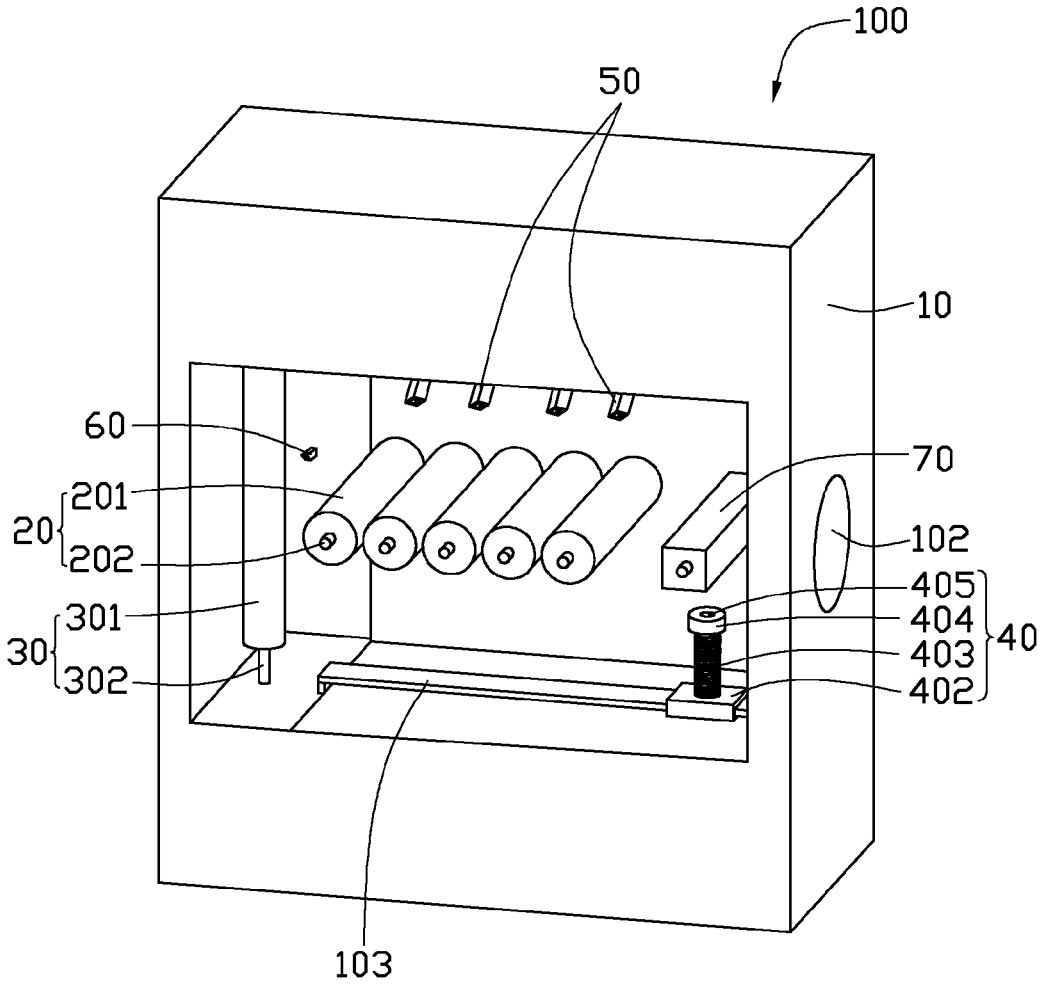
FIG. 2 is similar to FIG. 1, but showing the cylindrical grinding and polishing device at another angle.
Figure 3:
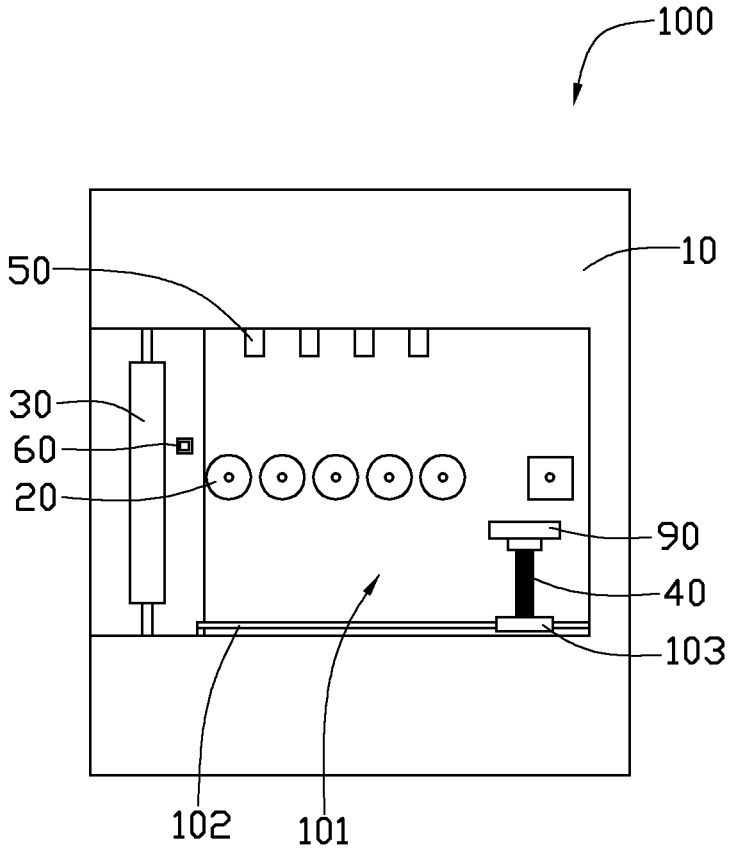
FIGS. 3-5 show a work-piece being rubbed and rolled by using the cylindrical grinding and polishing device of FIG. 1.

Referring to FIGS. 1-3, a cylindrical grinding and polishing device 100, according to an exemplary embodiment is shown. The cylindrical grinding and polishing device 100 includes a main body 10, a polishing device 20, a cylindrical grinding device 30, a support device 40, a first cleaning device 50, a second cleaning device 60, and a drying device 70. The polishing device 20, the cylindrical grinding device 30, and the support device 40 are all received in the main body 10. The support device 40 carries a work-piece 90 to process the work-piece 90 with the polishing device 20 and the cylindrical grinding device 30.

The main body 10 is a housing with a cuboid cavity 101 formed therein to receive the polishing device 20, the cylindrical grinding device 30, and the support device 40. The cavity 101 is substantially sealed to prevent the cut chips from sputtering out. The main body 10 defines an opening 102 communicating with the cavity 101 for ingress and egress of the work-piece 90. The opening 102 is positioned at an end of the cavity 101 along a longitudinal direction thereof. A sliding rail 103 is received in the cavity 101 and positioned at the bottom of the cavity 101. The sliding rail 103 extends along the longitudinal direction of the cavity 101.

The polishing device 20 includes a number of polishing wheel 201 arrayed along the longitudinal direction of the cavity 101. The polishing wheel 201 is barrel-shaped. Each polishing wheel 201 is rotatably connected to the main body 10 with a first shaft 202. The first shaft 202 is connected to a motor (not shown). The polishing wheel 201 is driven by the motor to rotate for polishing the work-piece 90 to remove the cutting chips after a cutting process. In the present embodiment, the polishing wheel 201 is positioned above the middle portion of the cavity 101. The polishing wheel 201 is an emery wheel. If the cutting chips after the cutting process on the surface of the work-piece 90 are hard to remove, a polishing wheel 201 with large grain is selected. If the work-piece 90 needs low surface abrasion, a polishing wheel 201 with small grain is selected.

The cylindrical grinding device 30 is positioned at an end of the cavity 101 away from the opening 102 along a direction substantially perpendicular to the longitudinal direction of the cavity 101. The cylindrical grinding device 30 grinds the outer diameter of the polished work-piece 90. The cylindrical grinding device 30 includes a grinding wheel 301. The grinding wheel 301 is barrel-shaped. The grinding wheel 301 is rotatably connected to the main body 10 with a second shaft 302. The second shaft 302 is connected to a motor (not shown). The grinding wheel 301 is driven by the motor to rotate for grinding the outer diameter of the work-piece 90. The rotating direction of the grinding wheel 301 is perpendicular to the rotating direction of the polishing wheel 201 because the rolled surface of the grinding wheel 301 is perpendicular to the rubbed surface of the grinding wheel 301. The grinding wheel 301 is an emery wheel.

The support device 40 includes a drive unit 402, an elevation unit 403 fixed on the drive unit 402, and a support plate 404 fixed on the elevation unit 403. The drive unit 402 is slidably mounted on the slide rail 103. The drive unit 402 includes a stepper motor (not shown). The elevation unit 403 is mounted on the stepper motor and driven by the stepper motor to move up and down relative to the polishing wheel 201. In the present embodiment, the elevation unit 403 is a hollow threaded shaft. The support plate 404 is rotatably connected to an end of the elevation unit 403 away from the drive unit 402. The support plate 404 defines a suction hole 405 communicating with a vacuum device (not shown) by the elevation unit 403. The vacuum device is capable of providing different suction levels to hold the work-piece 90 on the support plate 404. The support device 40 includes a motor (not shown) for driving the drive unit 402 to move along the slide rail 103.

The first cleaning device 50 is positioned above the polishing device 20 for jetting cleaning fluid to the work-piece 90 during in the polishing process. The second cleaning device 60 is positioned adjacent to the cylindrical grinding device 30 for jetting cleaning fluid to the work-piece 90 during in the cylindrical grinding process. A collection and discharge device (not shown) is positioned at the bottom of the cavity 101 for collecting chips and discharging cleaning fluid. The drying device 70 is received in the cavity 101 and is adjacent to the opening 102. The drying device 70 dries the work-piece 90.

Figure 4:
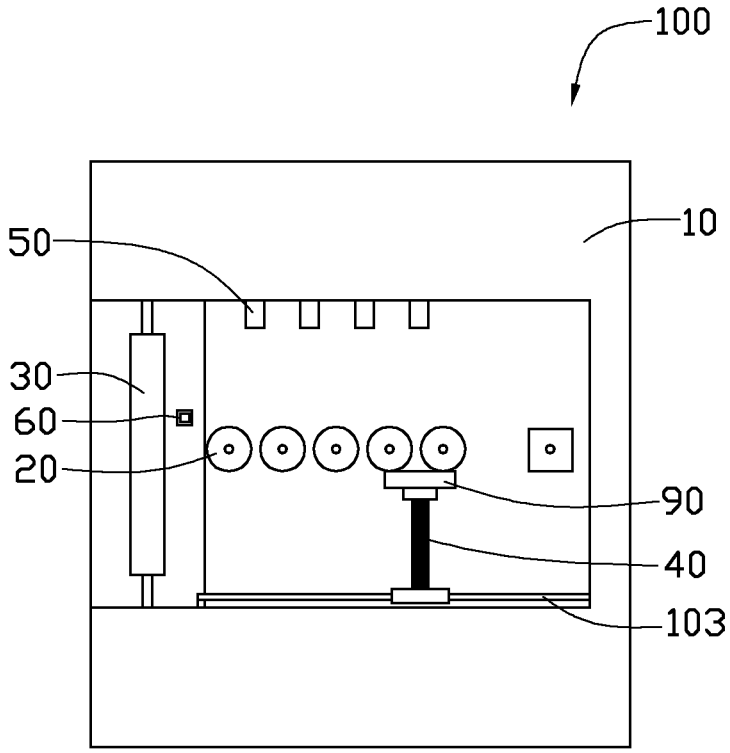
Figure 5:
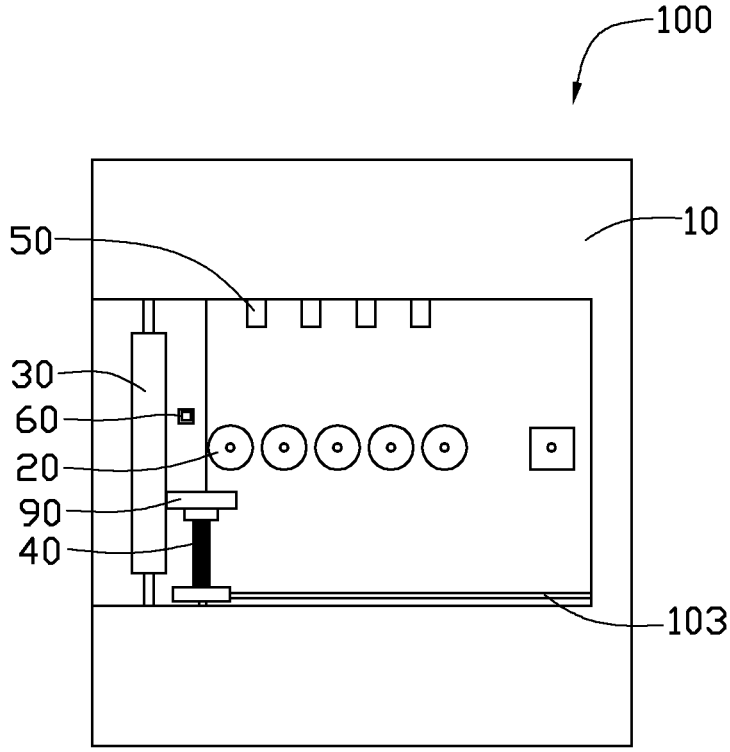

Referring to FIGS. 3-5, an operation process of the cylindrical grinding and polishing device 100 is shown. The support device 40 is moved to an end of the slide rail 103 near the opening 102, and the support plate 404 moves down towards the bottom of the cavity 101. The work-piece 90 is first put on the support plate 404 through the opening 102. The support plate 404 engages the work-piece 90. Then the support device 40 moves towards the opposite end of the slide rail 103. The motor of the support device 40 drives the elevation unit 403 to rise until the surface of the work-piece 90 contacts with the polishing wheel 201. The polishing wheel 201 turns to polishing the surface of the work-piece 90 to remove the chips from the work-piece 90. The support device 40 reciprocates along the slide rail 103 to rub the surface of the work-piece 90 substantially. The first cleaning device 50 jets cleaning fluid to the work-piece 90 when the work-piece 90 is rubbed. The support device 40 moves to the opening 102 when the surface of the work-piece 90 is rubbed completely. The work-piece 90 is reversed through the opening 102 and is put on the support plate 404 again, and the aforementioned polishing process is repeated to rub the reverse surface of the work-piece 90.

The support device 40 moves to the grinding wheel 301 when the two surfaces of the work-piece 90 are completely rubbed. The work-piece 90 makes contact with the grinding wheel 301. The grinding wheel 301 turns and rotates the work-piece 90 to grind the work-piece 90 into a circular shape. The second cleaning device 60 jets cleaning fluid at the work-piece 90 when the work-piece 90 is rolled.

The support device 40 moves to the opening 102 when the work-piece 90 is completely rolled. The drying device 70 dries the work-piece 90. Finally, the work-piece 90 is taken out from the opening 102.

While certain embodiments have been described and exemplified above, various other embodiments will be apparent to those skilled in the art from the foregoing disclosure. The present disclosure is not limited to the particular embodiments described and exemplified, and the embodiments are capable of considerable variation and modification without departure from the scope of the appended claims.

What is claimed is:

1. A cylindrical grinding and polishing device, comprising:

a main body defining a cavity therein;

a polishing device received in the cavity, the polishing device comprising a plurality of polishing wheels positioned along a first direction;

a cylindrical grinding device received in the cavity, the cylindrical grinding device comprising a grinding wheel positioned at an end of the cavity along a second direction substantially perpendicular to the first direction; and a support device received in the cavity, the support device comprising a support plate for supporting a work-piece, the support device capable of carrying the work-piece to contact the polishing wheels or the grinding wheel; and a sliding rail received in the cavity, the slide rail being positioned on the bottom of the cavity and extending parallel to the first direction of the cavity, wherein the support device comprises a drive unit and an elevation unit, the drive unit is slidably positioned on the slide rail, the elevation unit is capable of being driven by the drive unit to move toward or away from the polishing wheels, and the support plate is rotatably connected to an end of the elevation unit.

2. The cylindrical grinding and polishing device as claimed in claim 1, wherein the main body defines an opening communicating with the cavity for ingress and egress of the work-piece.

3. The cylindrical grinding and polishing device as claimed in claim 1, wherein the support plate defines a suction hole for sucking the work-piece.

4. The cylindrical grinding and polishing device as claimed in claim 3, wherein the elevation unit is a hollow threaded shaft, the suction hole is communicated to the elevation unit.

5. The cylindrical grinding and polishing device as claimed in claim 1, further comprising a first cleaning device positioned over the polishing device for jetting cleaning fluid to the work-piece during a polishing process.

6. The cylindrical grinding and polishing device as claimed in claim 1, further comprising a second cleaning device positioned adjacent to the cylindrical grinding device for jetting cleaning fluid to the work-piece during a cylindrical grinding process.

7. The cylindrical grinding and polishing device as claimed in claim 1, further comprising a drying device received in the cavity for drying the work-piece.

8. The cylindrical grinding and polishing device as claimed in claim 1, wherein each of the polishing wheels and the grinding wheel are emery wheels.

9. The cylindrical grinding and polishing device as claimed in claim 1, wherein each of the polishing wheels and the grinding wheel are barrel-shaped.

10. The cylindrical grinding and polishing device as claimed in claim 1, wherein the cavity is cuboid shaped.

* * * * *